US009382816B2

(12) United States Patent
Almbauer et al.

(10) Patent No.: US 9,382,816 B2
(45) Date of Patent: Jul. 5, 2016

(54) METHOD AND APPARATUS FOR OPERATING A STEAM CYCLE PROCESS WITH A LUBRICATED EXPANDER

(75) Inventors: Raimund Almbauer, Graz (AT); Roland Kalb, Leoben (AT); Roland Kirchberger, Graz (AT); Josef Klammer, Garsten (AT)

(73) Assignee: MAN Truck & Bus AG, Munich (DE)

( * ) Notice: Subject to any disclaimer, the term of this patent is extended or adjusted under 35 U.S.C. 154(b) by 461 days.

(21) Appl. No.: 13/701,378

(22) PCT Filed: May 24, 2011

(86) PCT No.: PCT/EP2011/002573

§ 371 (c)(1), (2), (4) Date: Feb. 7, 2013

(87) PCT Pub. No.: WO2011/151029

PCT Pub. Date: Dec. 8, 2011

(65) Prior Publication Data

US 2013/0263598 A1 Oct. 10, 2013

(30) Foreign Application Priority Data

Jun. 1, 2010 (DE) ..... 10 2010 022 408

(51) Int. Cl.
*F01K 15/00* (2006.01)
*C10M 171/00* (2006.01)
(Continued)

(52) U.S. Cl.
CPC ..... *F01K 15/00* (2013.01); *C10M 171/00* (2013.01); *F01K 15/02* (2013.01); *F01K 23/065* (2013.01);
(Continued)

(58) Field of Classification Search
CPC ..... F01K 25/06; F25B 43/02; B05B 5/00
USPC ..... 60/670, 692, 694, 686; 418/84, 97, 98
See application file for complete search history.

(56) References Cited

U.S. PATENT DOCUMENTS 4,008,573 A 2/1977 Petrillo
8,568,608 B2 10/2013 Shiflett et al.
(Continued)

FOREIGN PATENT DOCUMENTS

DE 10 2007 043 373 3/2009
DE 10 2008 046 543 3/2010
(Continued)

OTHER PUBLICATIONS

English Translation WO 2009036857 A2.*

*Primary Examiner* — Thomas Denion
*Assistant Examiner* — Shafiq Mian
(74) *Attorney, Agent, or Firm* — Cozen O'Connor

(57) ABSTRACT

Embodiments of the invention relate to a method for operating a steam cycle process performed in an apparatus having an evaporator or steam generator for the evaporation of a liquid working medium and an expander, which is lubricated by a lubricant, for the performance of mechanical work. The method comprises a) supplying the liquid working medium to the evaporator, in which it evaporates and is fed to the expander in the form of steam; b) supplying an ionic liquid, which at room temperature forms two liquid phases with the liquid working medium, to the expander as a lubricant; and c) separating the ionic liquid forming the lubricant for the expander from the working medium upstream of the evaporator.

27 Claims, 4 Drawing Sheets

(51) Int. Cl.

| | |
|---|---|
| ***F01K 15/02*** | (2006.01) |
| ***F01K 23/06*** | (2006.01) |
| ***F01K 25/10*** | (2006.01) |

(52) U.S. Cl.

CPC ..... *F01K 25/10* (2013.01); *C10M 2215/224* (2013.01); *C10M 2219/042* (2013.01); *C10M 2219/044* (2013.01); *C10M 2219/06* (2013.01); *C10M 2223/04* (2013.01); *C10N 2220/04* (2013.01); *C10N 2220/302* (2013.01); *C10N 2220/303* (2013.01); *C10N 2220/305* (2013.01)

(56) References Cited

U.S. PATENT DOCUMENTS

| | | | | |
|---|---|---|---|---|
| 2006/0251961 | A1 | 11/2006 | Olbert et al. | |
| 2006/0264645 | A1* | 11/2006 | Zhou et al. | 548/335.1 |
| 2010/0034684 | A1 | 2/2010 | Ast et al. | |
| 2010/0077792 | A1 | 4/2010 | Gurin | |
| 2010/0132384 | A1* | 6/2010 | Shiflett et al. | 62/112 |
| 2011/0265476 | A1* | 11/2011 | Berger et al. | 60/651 |

FOREIGN PATENT DOCUMENTS

| | | | | |
|---|---|---|---|---|
| EP | 2 161 417 | | 3/2010 | |
| JP | 06-026309 | | 2/1994 | |
| JP | 2004-346843 | | 12/2004 | |
| JP | 2009-539060 | | 11/2009 | |
| RU | 2291307 | | 1/2007 | |
| SU | 286962 | | 11/1970 | |
| WO | WO 2007/143051 | | 12/2007 | |
| WO | WO 2008/082561 | | 7/2008 | |
| WO | WO2008124087 | A1 * | 10/2008 | F25B 17/00 |
| WO | WO 2009/017473 | | 2/2009 | |
| WO | WO 2009/027008 | | 3/2009 | |
| WO | WO 2009036857 | A2 * | 3/2009 | 60/651 |
| WO | WO 2010017981 | A2 * | 2/2010 | 60/651 |

* cited by examiner

METHOD AND APPARATUS FOR OPERATING A STEAM CYCLE PROCESS WITH A LUBRICATED EXPANDER

CROSS-REFERENCE TO RELATED APPLICATIONS

This is a U.S. national stage of application No. PCT/EP2011/002573 filed 24 May 2011. Priority is claimed on German Application No. 10 2010 022 408.1 filed 1 Jun. 2010, the content of which is incorporated herein by reference in its entirety.

BACKGROUND OF THE INVENTION

1. Field of the Invention

The invention relates to a method for operating a steam cycle process with a lubricated expander based on the positive displacement principle, and to an apparatus for operating a steam cycle process.

2. Background of the Invention

Steam cycle processes with expanders are known for example from DE 10 2007 020 086 D3. The expander may for example be in the form of a piston expander, vane expander, rotary piston expander, swashplate expander, oblique-disk expander, roots expander or screw expander. In the positive displacement principle, the fresh vapor conducted out of the vapor generator is conducted into the working chamber of the expander. The fresh vapor conducted into the working chamber is expanded in the working stroke, with an output of work, owing to a volume-expanding movement of components. The expanded vapor, when it reaches its greatest volume, is conducted out of an outlet opening into a vapor discharge line. As vapor, use may be made not only of water vapor but also, as is known, of other inorganic and organic volatile substances, for example ammonia, alkanes, fluorinated hydrocarbons, siloxanes and refrigerants in general.

Many expanders must be lubricated with a dedicated lubricant, wherein the working medium and lubricant come into contact. In the remainder of the circuit, the working medium is completely liquefied in the condenser, raised to a higher pressure in the pump, and at least partially evaporated in the vapor generator.

A major problem in the cycle process is the selection of the lubricant. Since most lubricants are heat-sensitive, as complete as possible a separation of the lubricant from the working medium upstream of the evaporator is one option for making it possible to use heat-sensitive lubricants.

To be able to realize fuel savings, in particular in the case of mobile internal combustion engines, such as for example motor vehicle internal combustion engines, priority is presently given to two technical solutions. Different hybrid concepts are expedient for city and distribution transport owing to the braking and acceleration processes which arise there. Heat recovery systems are also known, which utilize the waste heat of the internal combustion engine to provide additional drive energy. Such systems for waste heat utilization are expedient, in the case of mobile internal combustion engines, in particular for vehicles used for long-distance transport.

In waste-heat utilization systems of this type, the waste heat generated in the region of the internal combustion engine and/or in the exhaust line is at least partially transmitted to a secondary heat circuit. In the secondary heat circuit, a working medium is circulated and in the process is usually at least partially evaporated in an evaporator. The vapor is expanded in an expansion unit, for example in a piston expander, and is finally liquefied again in a condenser. The condensed working medium is thereafter raised to the evaporation pressure by means of a pump unit, and the circuit is thus closed. The mechanical work generated by the expansion unit is supplied as additional work to the drive system, such as to a vehicle drive system.

DE 10 2006 043 139 A1 discloses a heat recovery system for an internal combustion engine. In the described system, additional drive energy is provided to the vehicle from the waste heat of the internal combustion engine and/or of the exhaust system. After the expansion of the vaporous working medium in the expander, the working medium of the secondary heat circuit is conveyed into a condenser in which it is liquefied with an output of heat, such that the corresponding steam cycle process is closed.

The use of expanders for the utilization of waste heat of internal combustion engines requires a complex design. To be able to meet all demands with regard to weight, costs, durability and necessary servicing, components which abrade against one another, for example piston-cylinder pairings, plain bearings, slides etc., are lubricated with oil. As a result, there is contact between the working medium and the lubricant or lubricated surfaces. This gives rise to the problem of mixture of the two working media, which may be transported onward in the circuit in the direction of the pump and evaporator together; this may have many adverse side effects.

SUMMARY OF THE INVENTION

To be able to operate the cycle process economically over a long period of time, the overall design must ensure an effective separation of the lubricating oil from the vapor of the working medium upstream of the inlet into the evaporator. The effective separation of the oil and vapor circuits reliably prevents the lubricating oil from passing into the hot evaporator region and, there, leading to contamination of the components and of the working media with decomposition products of the lubricant. The majority of the lubricants known from the prior art have an emulsifying effect with the working medium (for example in the case of water-water vapor) or can mix with the working medium (for example in the case of hydrocarbons). In any case, the lubricants from the prior art also have a vapor pressure. The lubricant vapor cannot practically be separated from the vapor of the working medium. As a result, some of the lubricant passes into the evaporator by means of the transport of the heat carrier medium in the cycle process, and in the evaporator the lubricant is exposed to high temperatures which lead to premature aging, chemical conversion (for example cracking) and ultimately thermal breakdown of the lubricant. The lubricant is thus changed in terms of its properties, and can thus no longer adequately perform its lubrication functions.

It is an object of embodiments of the invention to provide a method for operating a steam cycle process in which the lubricant can be separated from the working medium in a highly effective manner downstream of the expander.

This object is achieved, in one embodiment, in a method for operating a steam cycle process which is implemented in an apparatus having an evaporator or vapor generator for evaporating a liquid working medium and an expander lubricated by a lubricant, for generating kinetic energy and/or performing mechanical work. In this embodiment the methods comprises:

a) supplying the liquid working medium to the evaporator, where it is evaporated and supplied in vapor form to the expander;

b) supplying to the expander, as lubricant, an ionic liquid which forms two liquid phases with the liquid working medium at room temperature; and c) separating the ionic liquid which forms the lubricant for the expander from the working medium upstream of the evaporator.

Embodiments of the invention are based on the realization that ionic liquids, if they form two liquid phases with the working medium in the liquid state at room temperature (approximately 20° Celsius or 293 Kelvin), are very highly suitable for being used as lubricating oil. Ionic liquids naturally have a very low vapor pressure, which has a further expedient effect on the method according to the invention.

Here, the ionic liquid lubricant is separated in a separation device downstream of the expander. The expander is formed for example by a piston expander which has at least one working piston, has only a small amount of or almost no working medium dissolved therein in any form, and can thus be supplied directly back to the lubricant circuit. In the lubricant circuit, the lubricant is conveyed again to the abradant parts of the expander.

Ionic liquids are—within the context of the recognized literature (for example Wasserscheid, Peter; Welton, Tom (Eds.); "*Ionic Liquids in Synthesis*", Verlag Wiley-VCH 2008; ISBN 978-3-527-31239-9; Rogers, Robin D.; Seddon, Kenneth R. (Eds.); "*Ionic Liquids—Industrial Applications to Green Chemistry*", ACS Symposium Series 818, 2002; ISBN 0841237891)—liquid organic salts or salt mixtures composed of organic cations and organic or inorganic anions, with melting points lower than 100° C.

In the implementation of the method according to embodiments of the invention, the ionic liquid lubricant has good lubrication properties (viscosity, temperature stability, long-term stability, etc.), low corrosivity and low adverse environmental effects (disposal, toxicity, etc.).

Ionic liquids have properties of interest for use as lubricating and hydraulic liquids, for example a low cavitation tendency owing to the immeasurably low vapor pressure, very high thermal stability, very high pressure resistance (=low compressibility), good lubrication properties, a high viscosity index, low flammability to non-flammability, and high thermal conductivity, etc. (see for example A. Jimenez, M. Bermudez, P. Iglesias, F. Carrion, G. Martinez-Nicolas, *Wear* 260, 2006, 766-778; Z. Mu, F. Zhou, S. Zang, Y. Liang, W. Liu, *Tribology International* 2005, 38, 725-731; C. Jin, C. Ye, B. Phillips, J. Zabrinski, X. Liu, W. Liu, J. Shreeve, *J. Mater Chem.* 2006, 16, 1529-1535, and DE102008024284).

The ionic lubricants may furthermore be provided with ionic and/or molecular additives, for example:

Wear reducers (Anti wear)
Friction reducers (Friction Modifiers)
Scuff prevention additives (Extreme pressure additives)
Viscosity modifiers
Viscosity index improvers (VI improvers)
Corrosion prevention additives
Aging prevention additives, antioxidants
Defoamers (Anti foam additives)
Biocides
Tensides and demulgators
Dispersing agents and surfactants
Acidity regulators
Complexing agents
Thermal stabilizers
Hydrolysis stabilizers It has been found that for a primary separation of the ionic lubricant from the working medium, near quantitative immiscibility of the working medium in the ionic lubricant is advantageous. The solubility of the ionic lubricant in the working medium may be <0.1 m %, <100 ppm, <10 ppm, or <1 ppm.

The solubility of the working medium in the ionic lubricant may be <5 m %, <1 m %, or <0.1 m %.

The ionic liquid lubricant may have no emulsifying effect, that is to say to have no or only minor properties which lower the interfacial surface tension.

The separation of the ionic liquid lubricant from the working medium may take place during the course of the steam cycle process in a single-stage or multi-stage or in a single-stage or multi-stage separation device, based on the operating principles and/or apparatus technology described below:

a.) As a result of a difference in density by gravity or centrifugal force (by means of acceleration fields): ionic liquids such as, for example, 1-ethyl-3-methylimidazolium bis(trifluoromethylsulfonyl)imide (see U.S. Pat. Nos. 5,827,602 and 6,531,241, Covalent Associates Inc.) and 1-ethyl-3-methylimidazolium tris(pentafluoroethyl)trifluorophosphate (see Journal of Fluorine Chemistry (2005), 126(8), 1150-1159) exhibit densities of >1.5 g/cm$^3$, are for example completely immiscible with water, exhibit no emulsifying capability, but have good lubrication properties and are completely hydrolytically stable. They separate as a result of the difference in density. Alternatively, it is also possible for ionic lubricants of low density (minimum 0.7 g/cm$^3$) to be combined with working media of high density such as, for example, fluorinated hydrocarbons (densities from 1.5-2.0 g/cm$^3$); in this case, the ionic lubricant separates off as the upper phase.

b.) Mechanically.

c.) Through the use of coalescence filters and/or coalescence separators.

d.) Through the use of polymers as a filter, for example polymers of spatial globular structure (RGS polymers), ion-exchange resins, diaphragms (for example PTFE, Nylon) and other sorptive surfaces which have affinity to the respective ionic lubricant, for example, having a low interfacial surface tension.

e.) By ultrafiltration.

f.) Through the use of demulsifiers, such as surfactants which crack emulsions.

g.) By evaporation of the working medium at temperatures below the decomposition point of the ionic lubricant.

h.) Through the use of strong electric fields. On electrode surfaces through the application of a direct-current or alternating-current voltage.

j.) By ultrasound.

k.) By any combinations of a.-j.

In the case of a multi-stage separation of the ionic fluid lubricant from the working medium, it is possible, after primary separation has taken place, for any traces still present to be removed, for example, by filtration of the ionic fluid by filters and/or filter diaphragms. The filters may be composed of the materials described above in c., d. or e. above. Conventional ion-exchange resins or activated carbon, silica gel or other adsorbents for removing organic traces may also be used. Electrochemical oxidation on diamond electrodes or Ru/Ta or Ru/Ir mixed oxide electrodes, for example, may also be used.

A column-like separation vessel of slim construction, where the base surface of which is small in relation to the height or areal extent in a vertical axis direction, may be used. In the case of moving objects such as, for example, a vehicle, a space-saving construction is thereby attained and the mixing of the two phases is hindered. Such column-like configurations are also intended to encompass vessels which are partially or wholly in curved or serpentine-like form.

Suitable working media are, for example, water vapor or any other volatile or evaporable substance, such as ammonia, alkanes, fluorinated hydrocarbons, siloxanes or a refrigerant. The expression "vaporous" is to be understood in a broad sense and is also intended to encompass gaseous states of the working medium.

Ionic liquids which can be used in the method according to the invention are, for example, 1-ethyl-3-methylimidazolium bis(trifluoromethylsulfonyl)imide, 1-ethyl-3-methylimidazolium tris(pentafluoroethyl)trifluorophosphate, 1-ethyl-3-methylimidazolium tris(perfluoroalkyl)trifluorophosphate, 1-ethyl-3-methylimidazolium ethyl sulfate, 1-ethyl-3-methylimidazolium methyl sulfate, 1-ethyl-3-methylimidazolium methane sulfonate, 1-ethyl-3-methylimidazolium diethyl phosphate, 1-ethyl-3-methylimidazolium dibutyl phosphate, 1-methyl-3-methylimidazolium dicyanamide, 1-ethyl-3-methylimidazolium perfluoroalkyl sulfonate, 1-ethyl-3-methylimidazolium perfluoroalkyl carboxylate, 1-ethyl-3-methylimidazolium thiocyanate, 1-ethyl-3-methylimidazolium tricyanomethide, 1-propyl-3-methylimidazolium bis(trifluoromethylsulfonyl)imide, 1-propyl-3-methylimidazolium tris(pentafluoroethyl)trifluorophosphate, 1-propyl-3-methylimidazolium tris(perfluoroalkyl)trifluorophosphate, 1-propyl-3-methylimidazolium ethyl sulfate, 1-propyl-3-methylimidazolium methyl sulfate, 1-propyl-3-methylimidazolium methane sulfonate, 1-propyl-3-methylimidazolium diethyl phosphate, 1-propyl-3-methylimidazolium dibutyl phosphate, 1-propyl-3-methylimidazolium perfluoroalkyl sulfonate, 1-propyl-3-methylimidazolium perfluoroalkyl carboxylate, 1-propyl-3-methylimidazolium dicyanamide, 1-propyl-3-methylimidazolium thiocyanate, 1-propyl-3-methylimidazolium tricyanomethide, 1-butyl-3-methylimidazolium bis(trifluoromethylsulfonyl)imide, 1-butyl-3-methylimidazolium tris(pentafluoroethyl)trifluorophosphate, 1-butyl-3-methylimidazolium tris(perfluoroalkyl)trifluorophosphate, 1-butyl-3-methylimidazolium ethyl sulfate, 1-butyl-3-methylimidazolium methyl sulfate, 1-butyl-3-methylimidazolium methane sulfonate, 1-butyl-3-methylimidazolium diethyl phosphate, 1-butyl-3-methylimidazolium dibutyl phosphate, 1-butyl-3-methylimidazolium perfluoroalkyl sulfonate, 1-butyl-3-methylimidazolium perfluoroalkyl carboxylate, 1-butyl-3-methylimidazolium dicyanamide, 1-butyl-3-methylimidazolium thiocyanate, 1-butyl-3-methylimidazolium tricyanomethide, 1-ethyl-1-methylpyrrolidinium bis(trifluoromethylsulfonyl)imide, 1-ethyl-1-methylpyrrolidinium tris(pentafluoroethyl)trifluorophosphate, 1-ethyl-1-methylpyrrolidinium tris(perfluoroalkyl)trifluorophosphate, 1-ethyl-1-methylpyrrolidinium ethyl sulfate, 1-ethyl-1-methylpyrrolidinium methyl sulfate, 1-ethyl-1-methylpyrrolidinium methane sulfonate, 1-ethyl-1-methylpyrrolidinium diethyl phosphate, 1-ethyl-1-methylpyrrolidinium dibutyl phosphate, 1-ethyl-1-methylpyrrolidinium dicyanamide, 1-ethyl-1-methylpyrrolidinium perfluoroalkyl sulfonate, 1-ethyl-1-methylpyrrolidinium perfluoroalkyl carboxylate, 1-ethyl-1-methylpyrrolidinium thiocyanate, 1-ethyl-1-methylpyrrolidinium tricyanomethide, 1-butyl-1-methylpyrrolidinium bis(trifluoromethylsulfonyl)imide, 1-butyl-1-methylpyrrolidinium tris(pentafluoroethyl)trifluorophosphate, 1-butyl-1-methylpyrrolidinium tris(perfluoroalkyl)trifluorophosphate, 1-butyl-1-methylpyrrolidinium ethyl sulfate, 1-butyl-1-methylpyrrolidinium methyl sulfate, 1-butyl-1-methylpyrrolidinium methane sulfonate, 1-butyl-1-methylpyrrolidinium diethyl phosphate, 1-butyl-1-methylpyrrolidinium dibutyl phosphate, 1-butyl-1-methylpyrrolidinium dicyanamide, 1-butyl-1-methylpyrrolidinium perfluoroalkyl sulfonate, 1-butyl-1-methylpyrrolidinium perfluoroalkyl carboxylate, 1-butyl-1-methylpyrrolidinium thiocyanate, 1-butyl-1-methylpyrrolidinium tricyanomethide, tetraalkylammonium bis(trifluoromethylsulfonyl)imide or tetraalkylammonium tris(pentafluoroethyl)trifluorophosphate, tetraalkylammonium tris(perfluoroalkyl)trifluorophosphate, tetraalkylammonium ethyl sulfate, tetraalkylammonium methyl sulfate, tetraalkylammonium methane sulfonate, tetraalkylammonium diethyl phosphate, tetraalkylammonium dibutyl phosphate, tetraalkylammonium dicyanamide, tetraalkylammonium perfluoroalkyl sulfonate, tetraalkylammonium perfluoroalkyl carboxylate, tetraalkylammonium thiocyanate, tetraalkylammonium tricyanomethide, or mixtures thereof.

Suitable ionic liquids for use with water or ammonia as working medium are in particular those which have fluorinated anions and/or cations with one or more medium-length alkyl chains (C5 to C10). Suitable ionic liquids for use with siloxanes, alkanes or fluoroalkanes as working medium are in particular those which comprise small, polar anions and/or cations which comprise oxygen atoms and which have one or more short, possibly oxygen-substituted alkyl chains (C1 to C4).

In one embodiment, ionic liquid for lubricating the expander is supplied to the vaporous working medium upstream of the expander and is thus supplied to the expander together with the working medium. This involves so-called mixture lubrication. Alternatively, or additionally if appropriate, the ionic liquid may be metered directly into the expander in order to realize circulating lubrication, for example. The ionic liquid is then conducted in a targeted fashion to the lubricating points of the expander. With both variants, an advantageous lubricant supply is provided which ensures reliable expander lubrication.

In a further embodiment of the steam cycle process according to the invention, the vaporous working medium is supplied, before being supplied again to the evaporator and downstream of the expander, to at least one condenser in which the vaporous working medium can be liquefied in a functionally reliable manner before being supplied again to the evaporator or vapor generator. As already stated above, the vaporous working medium is furthermore supplied downstream of the expander, to at least one separation device in which the ionic liquid can be separated from the working medium in a single-stage or multi-stage process. Here, numerous different options now emerge for the arrangement and/or series connection of condensers and separating devices, which are explained in more detail, and by way of example, below:

In a first variant, the condenser is arranged downstream of the expander and upstream of the separation device, such that the mixture of working medium and ionic liquid exiting the expander can be supplied to the condenser.

In a second variant, in the case of a working medium which exits the expander in vapor form, the condenser is arranged downstream of the separation device in the working medium circuit, such that an at least partially vaporous working medium passing from the separation device is supplied to the condenser.

A combination of both variants may also be provided.

For a particularly effective and economical steam cycle process, both the working medium and the ionic liquid which functions as lubricant are conducted in the circuit. Depending on the specific embodiment, in particular depending on the type of expander lubrication, the two circuits are mutually separate to a greater or lesser extent. In one embodiment the ionic liquid which functions as lubricant for the expander is conducted in a lubricant circuit in such a way that the ionic liquid is extracted from at least one lubricant reservoir and supplied to the expander, from where the ionic liquid is returned again to the at least one lubricant reservoir.

Here, the lubricant reservoir may very generally be formed by at least one separation device in which the ionic liquid is separated from the working medium in a single-stage or multi-stage process. The separation device thus performs a dual function, acting firstly as a reservoir for the ionic liquid or also as a reservoir for the working medium and secondly, in its original function, as a separator, which saves components and thus also saves installation space. In this connection, it is particularly advantageous for the lubricant reservoir to be formed by the at least one separation device as described above which is arranged downstream of the expander and to which is supplied the mixture of working medium and ionic liquid passing from the expander.

In a further embodiment, in the case of circuits completely separate from one another for the working medium and the ionic liquid, the lubricant reservoir is formed by a vessel which is assigned to the expander, in particular by an oil-sump-like vessel assigned to the expander, in which firstly the ionic liquid as liquid phase and secondly the vaporous working medium, which has entered into the lubricant circuit in the form of blow-by vapors, as vapor phase are accommodated. The ionic liquid is supplied from the vessel to the expander separately from and independently of the vaporous working medium, either by means of a pump or through a gravity-driven return line. The blow-by working medium vapors occur for example in the case of piston expanders, and there, pass along the side face of the piston from the working chamber in the direction of the crankcase. The vaporous working medium which collects in the vessel is likewise discharged from the vessel, for example by a crankcase ventilation line, via which the vaporous working medium can escape of its own accord owing to its vapor pressure (if appropriate, the vapors may also be sucked out by a corresponding auxiliary means).

Since it is the case not only that the lubricant circuit is contaminated with blow-by vapors but also that the working medium circuit is contaminated with ionic liquid, for example by a lubricant film which forms on the wall in the working chamber of a piston of a piston expander, it is provided in a further embodiment that the vaporous working medium which is discharged from the vessel and which is possibly contaminated with ionic liquid is supplied to the at least one separation device arranged downstream of the expander, to which separation device is also supplied the working medium passing from the expander and contaminated with ionic liquid. In this case, the vaporous working medium may be discharged from the vessel to be supplied, before being supplied to the at least one separation device, to a condenser in which the vaporous working medium is liquefied. The vessel may also be connected to the separation device in such a way that ionic liquid can flow from the separation device to the vessel and if appropriate in the opposite direction. With such an implementation according to the embodiment explained in more detail above, it is ensured in a simple manner that the ionic liquid does not accumulate to excessively large quantities in the working medium or in the working medium circuit. This increases operational reliability and also permits an optimized, small design and dimensioning of the apparatus and pipelines for the steam cycle process.

The object on which embodiments of the invention are based is furthermore achieved by an apparatus for operating a steam cycle process comprising an evaporator or vapor generator for evaporating a liquid working medium and an expander, which is lubricated by means of a lubricant, for generating kinetic energy and/or for performing mechanical work, wherein the lubricant is formed by an ionic liquid which forms two liquid phases with the liquid working medium at room temperature. A device of this type yields the same advantages as described above with respect to the method. Such advantages will not be repeated here.

The method and apparatus according to the invention may, be used for a wide variety of purposes and applications. In one application, by way of example, the method and/or of the apparatus according to embodiments of the invention are used in conjunction with a heat recovery device for a motor vehicle, in particular for a motor vehicle powered by an internal combustion engine, as described for example in DE 10 2006 028 868 A1. In this connection, the evaporator may be coupled in heat-transmitting fashion directly or indirectly to a heat source of the motor vehicle, in particular to an internal combustion engine and/or an exhaust system and/or a charge-air cooler. At the other side, the expander is then, for example, preferably connected or coupled in power-transmitting fashion indirectly or directly to a drivetrain and/or to an electric machine which can be operated as a generator and/or to at least one consumer of the motor vehicle, in particular a refrigeration and/or air-conditioning system.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Embodiments of the invention will be explained in more detail below on the basis of the drawings, which show preferred embodiments of the invention schematically and merely by way of example.

DETAILED DESCRIPTION OF THE PREFERRED EMBODIMENTS

Figure 1:
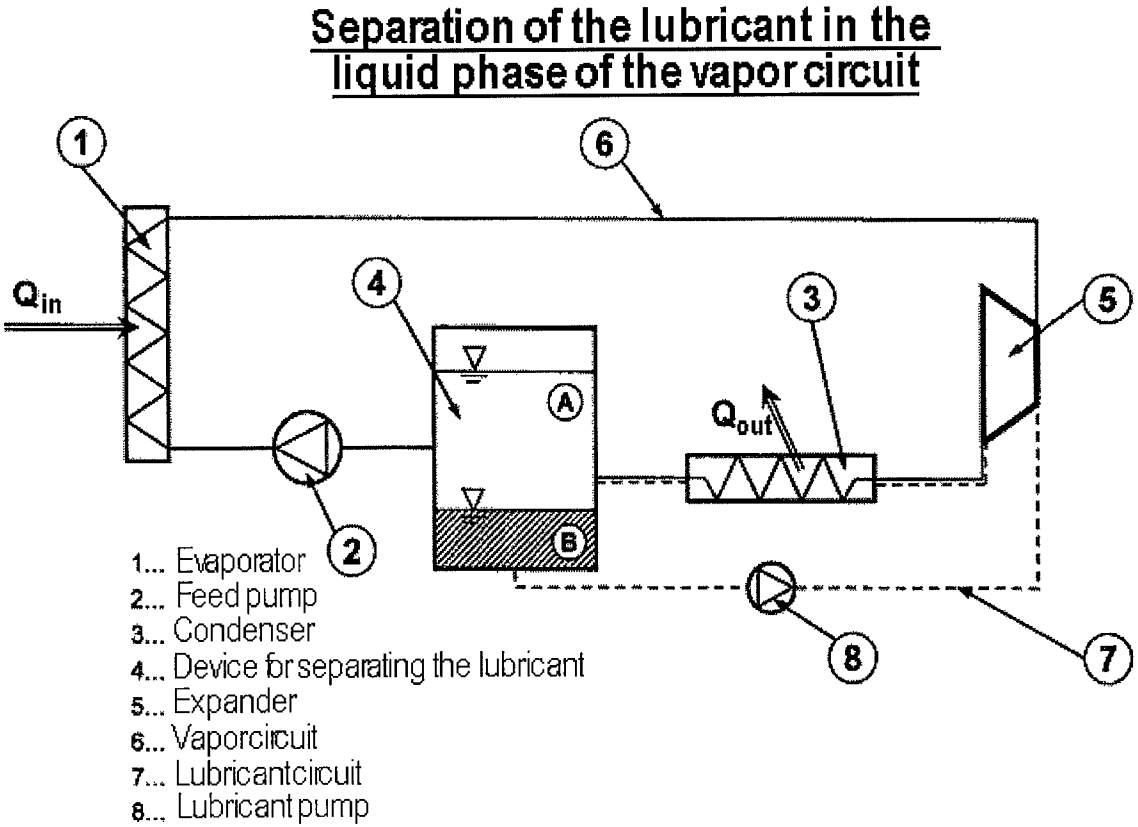
FIG. 1 is a schematic diagram of a steam cycle process according a first exemplary embodiment of the invention, in which a separation of the lubricant takes place in the liquid phase of the vapor circuit.

FIG. 1 is a schematic diagram of a steam cycle process according to a first exemplary embodiment of the invention, which has circuits for a working medium A and for an ionic liquid B which functions as lubricant.

Specifically, FIG. 1 shows a single-stage separation device 4 which is formed in this example by a gravity-driven separator to separate the ionic liquid B from the working medium A, in the liquid phase. In this example, the separation device 4 is formed by a column-like vessel in order to obtain as great as possible a height with a relatively small base area. The separation device is shown schematically in FIG. 1. Even significantly slimmer or more elongate embodiments are also possible. The circuit for the working medium A (in the present example, the liquid working medium A is lighter than the ionic liquid which functions as lubricant) is shown by the solid line 6, and the circuit for the ionic liquid B is shown by the dashed line 7.

An evaporator 1 is provided, in which the liquid working medium A is evaporated. The working medium A is for this purpose conveyed from the separation device 4 into the evaporator 1 by a feed pump 2.

Here, the evaporation heat $Q_{in}$ supplied to the evaporator 1 may come from different heat sources depending on the application. If such a steam cycle process is used in conjunction with, for example, a heat recovery system in a motor vehicle, the heat supplied to the evaporator 1 is preferably coupled out of an internal combustion engine and/or an exhaust system and/or a charge-air cooler. Depending on the location at which the heat is coupled out, it is possible for different evaporation temperatures to be provided at the evaporator 1, which demands a working medium correspondingly adapted to the predetermined temperature level. For example, water may be used as working medium only if the evaporation temperature at the evaporator 1 is considerably higher than 100° C., as is the case for example if the heat is coupled out of the exhaust system.

The vaporous working medium is transported from the evaporator 1 via a line 6 into the expander 5, where it expands and performs mechanical work. The mechanical work may be used in a variety of ways depending on the application. In conjunction with a motor vehicle, such as, for example, a utility vehicle, the mechanical work is supplied to the drive system, in particular to a vehicle drive system, and/or is converted into electrical current by an electric machine which can be operated as a generator in the vehicle, and/or is supplied to some other suitable consumer, for example a refrigeration system.

Figure 3:
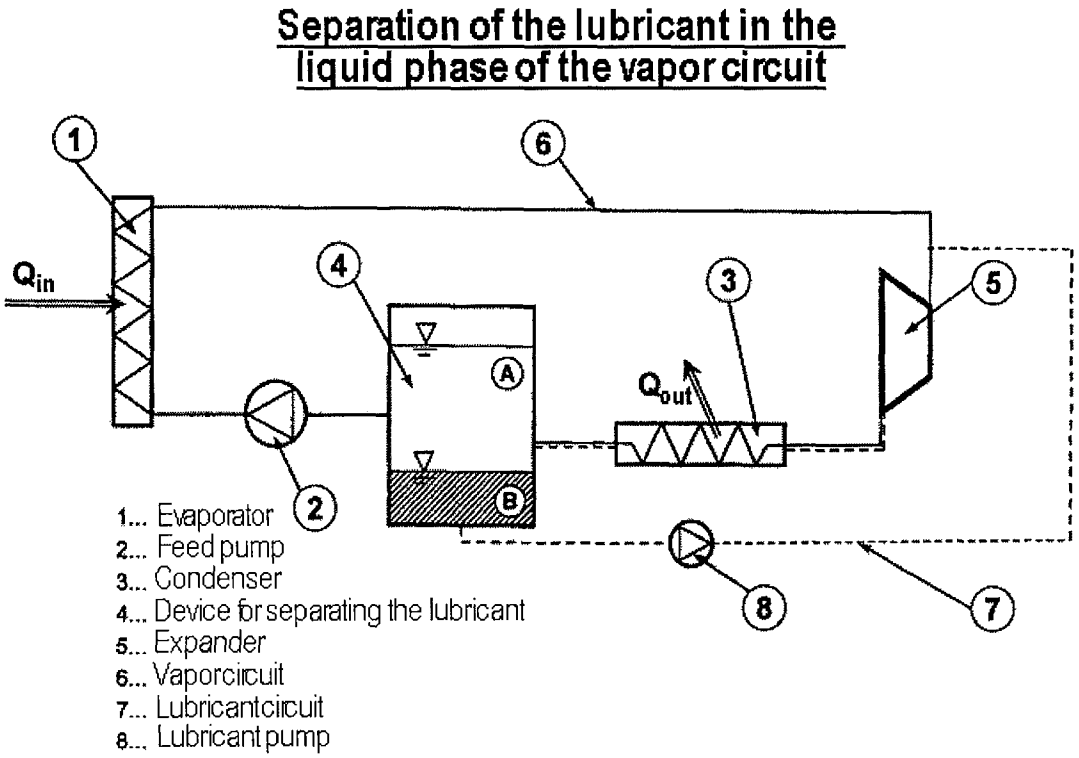
FIG. 3 is a schematic diagram of a steam cycle process according to a third exemplary embodiment of the invention, in which ionic liquid lubricant is admixed to the vaporous working medium upstream of an expander.

The ionic liquid lubricant B is also fed into the expander 5 via a line 7. There, the ionic liquid lubricant B performs the lubrication. The ionic liquid lubricant B may alternatively also be supplied upstream of the expander 5 to the vaporous working medium passing from the evaporator 1, as illustrated in FIG. 3, which is otherwise identical to the embodiment shown in FIG. 1.

From the expander 5, the mixture of vaporous working medium A and ionic liquid lubricant B passes into a condenser 3, where the mixture is liquefied. The waste heat $Q_{out}$ of the condenser 3 may then, depending on the application, be supplied again to a suitable system of the respective application. In the case of a motor vehicle, for example a utility vehicle, it is expedient for the waste heat to be supplied to a cooling system of the vehicle, for example. The liquefied mixture is conveyed into the separation device 4, where the ionic liquid lubricant B collects in the lower region because it is immiscible with the liquid working medium A and is in this case the specifically heavier liquid.

The ionic liquid lubricant B is extracted from the separation device 4 at the sump side by means of a pump 8 and is conducted into the expander 5 again via the line 7.

Figure 2:
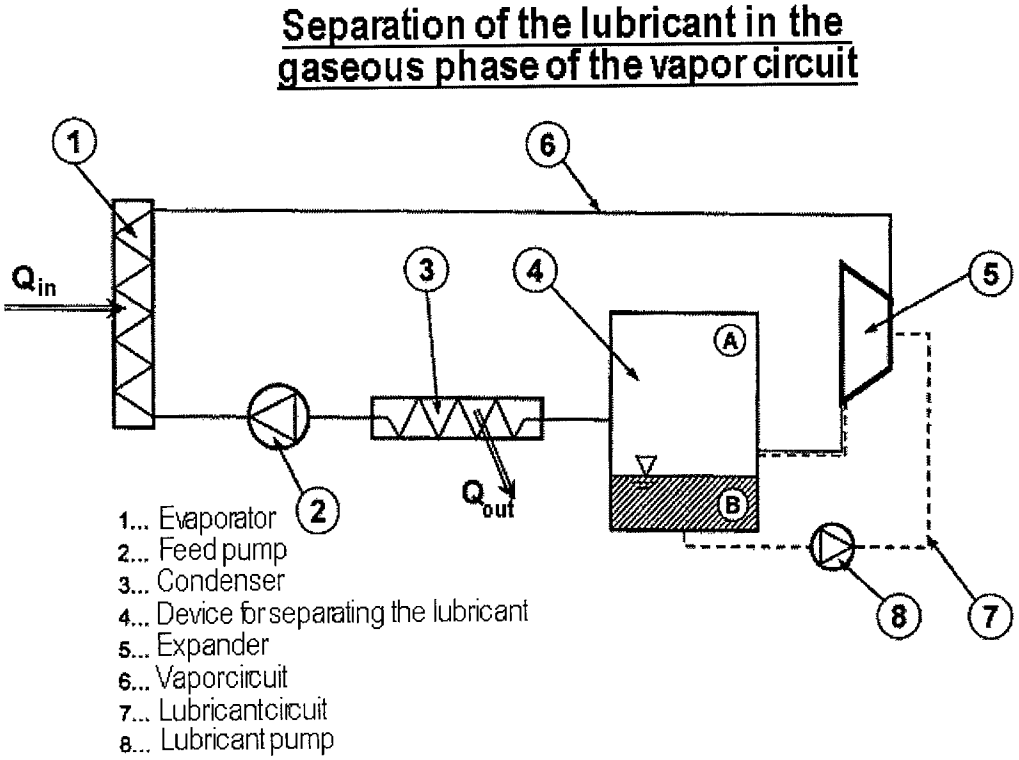
FIG. 2 is a schematic diagram of a steam cycle process according to a second exemplary embodiment of the invention, in which the separation of the lubricant takes place in the vaporous phase of the vapor circuit.

In a modification of the embodiment of FIG. 1 shown in FIG. 2, it is also possible for the condenser 3 to be provided downstream of the separation device 4 in the circuit of the working medium A, between the separation device 4 and the pump 2 in this example. This variant is expedient if the working medium exits the expander 5 substantially only as vapor. With such a implementation, particularly good separability of the vaporous working medium from the ionic liquid B in the separation device 4 is attained, wherein the possibly still vaporous fraction of the working medium passing from the separation device 4 is subsequently liquefied in the condenser 3 before being supplied to the evaporator 1.

Figure 4:
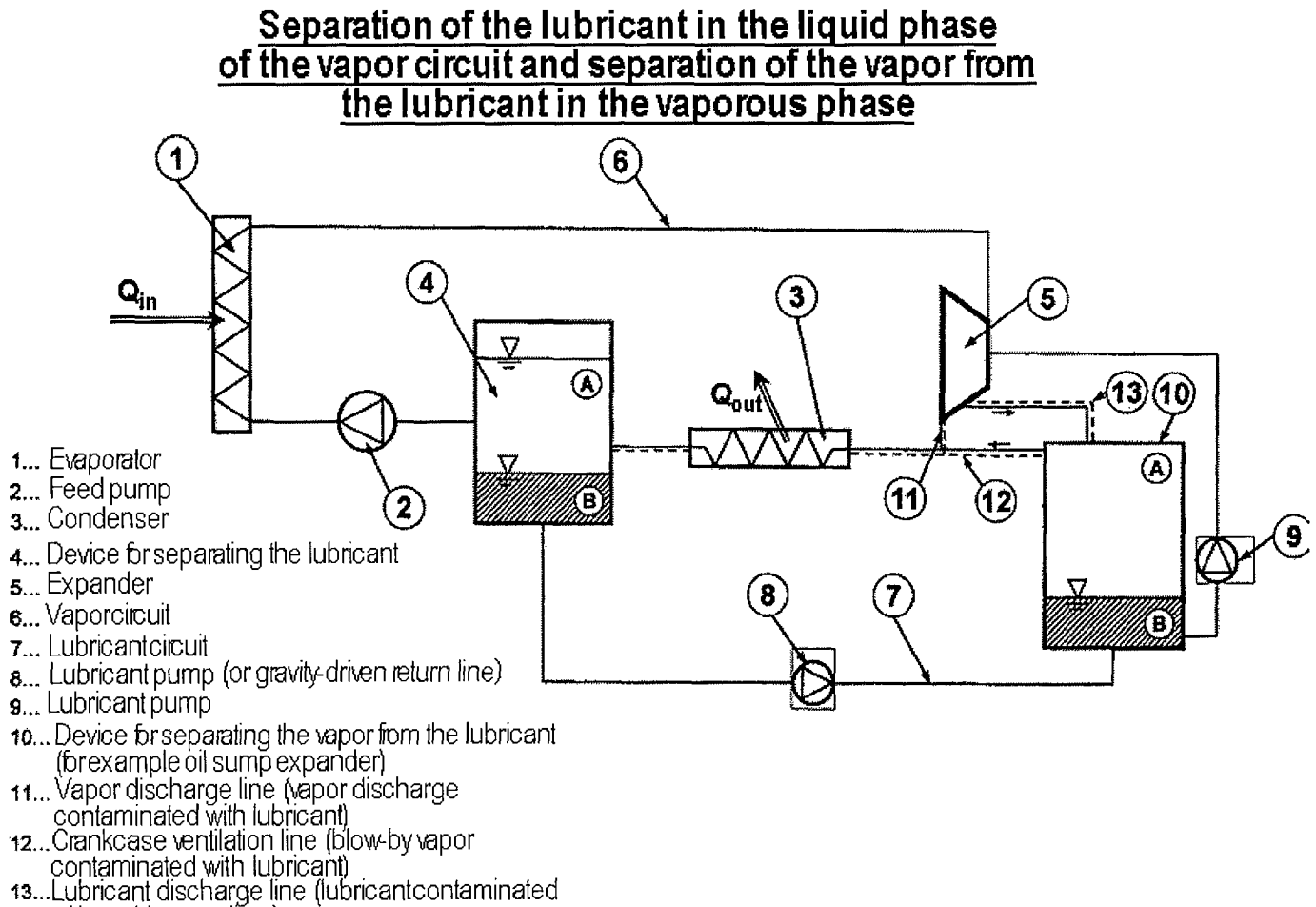
FIG. 4 is a schematic diagram of a steam cycle process according to a fourth exemplary embodiment of the invention, in which the separation of the lubricant takes place in the liquid phase of the vapor circuit and the separation of the vapor from the lubricant takes place in the vaporous phase.

FIG. 4 shows a further design variant which corresponds to the embodiment of FIG. 1 with regard to the arrangement of the expander 5, of the condenser 3, of the separation device 4 and of the evaporator 1, but with the difference that, in addition to the separation device 4, there is provided a device, forming a vessel 10, for separating the vapor out of the lubricant. The vessel 10 is arranged, for example, on the expander 5 in the manner of an oil sump, which is however not illustrated in detail here. The vessel 10 serves as a collecting receptacle for substantially vaporous working medium A which passes, in the form of blow-by vapors, for example, in the piston working chamber of the expander 5, from the working medium circuit to into the lubricant circuit 7. The piston working chamber may be a piston expander, for example. The vaporous working medium collects in the vessel 10 above the ionic liquid B, which forms a liquid phase. Here, the lubricant which is contaminated with ionic liquid in the form of blow-by working medium vapors, passes via a lubricant discharge line 13, which may be at the head side as schematically illustrated in FIG. 4, into the vessel 10.

From the vessel 10 there preferably branches off, at the vapor phase side, a discharge line 12 which in this example constitutes a crankcase ventilation line, through which the vaporous working medium which is contaminated with ionic liquid lubricant B is supplied to a waste vapor line 11 which branches off from the expander 5 and carries the contaminated working medium. The contaminants arise in particular from lubricating film layers on the walls in the working chamber, such that lubricant can pass from the lubricant circuit 7 into the circuit of the working medium.

The contaminated working medium flow is then supplied to the condenser 3, in which the working medium is condensed before it is subsequently supplied together with the ionic liquid lubricant B to the separation device 4. The ionic liquid lubricant B which collects in the sump of the separation device 4 may then be supplied to the vessel 10, for example such as to the sump side thereof, through a gravity-driven return line or, as shown here, optionally also by a lubricant pump 8.

As is further evident from FIG. 4, there may also be provided a lubricant pump 9 to draw ionic liquid lubricant B out of the vessel 10 and supply the ionic liquid lubricant B to the expander 5, for example.

It is also possible in conjunction with the exemplary embodiment of Figure for mixture lubrication as per the embodiment of FIG. 2 to alternatively or additionally be provided.

EXPERIMENTAL RESULTS

To use ionic liquids as lubricants in a steam cycle process in the present invention it is important for the ionic liquid to have suitable lubrication properties and the lowest possible miscibility of the vapor-generating working medium with the ionic liquid lubricant. Since the working medium is evaporated in the evaporator 1, the solubility of the ionic liquid in the working medium should be as low as possible. Vice versa, however, low solubility of the working medium in the ionic liquid is also desired in order to attain cavitation damage at the lubrication point.

Experiment 1

Case A: Separation by Gravity 50 g of 1-ethyl-3-methylimidazolium ethyl sulfate (ionic liquid) were stirred vigorously with 50 g of 1,1,3,3-tetramethyl disiloxane (vapor-generating working medium) in a closed round-bottomed flask for 2 hours by means of a magnetic stirrer and in a heating bath at a temperature of 80° C., which is a typical application temperature. The mixture was transferred into a shaking funnel and shaken very vigorously by hand for one minute. After the end of the shaking process, it was observed that a clean phase separation took place within a few seconds. After a waiting time of 2 minutes, which is a typical standing time for a phase separation by gravity in the typical application, the two phases were separated and poured, for measurement, into sample bottles.

Case B: Separation by Filtration

The process described above with respect to Case A was repeated with a second sample, wherein in addition to the separation by gravity, the separate-off operating medium was filtered through a 0.45 μm PTFE diagram filter.

Case C: Separation by Centrifuging and Filtration

The process described above with respect to Case A was repeated with a third sample, wherein in addition to the separation by gravity, the separated-off working medium was centrifuged at a speed of 5000 rpm for 10 minutes and then filtered through a 0.45 μm PTFE diaphragm filter.

Measurement of the Remaining Ionic Liquid in the Working Medium:

A weighed-out amount of a few grams of separated-off 1,1,3,3-tetramethyl disiloxane was vaporized on a rotary evaporator at 60° C. and under falling pressure to a final value of <10 mbar in order to separate the volatile working medium from the traces of the non-evaporable ionic liquid. Aside from a very small number of exceptions, ionic liquids have—as is generally known to a person skilled in the art—a nearly immeasurably low vapor pressure, and remain under such conditions quantitatively in the residue of the flask. The residue was then swilled and homogenized with 2-propanol "puriss p.a. for UV spectroscopy" in a 10 ml measurement flask. The extinction was then measured at a wavelength of 213 nm by means of a UV spectrometer versus a cuvette with 2-propanol. By standard addition of pure ionic liquid 1-ethyl-3-methylimidazolium ethyl sulfate in 10 ppm steps calculated for the original amount of 1,1,3,3-tetramethyl disiloxane, a calibration curve was established and the amount of dissolved ionic liquid was measured and calculated for the original concentration. The linear regression of the calibration curve $R^2$ was better than 0.95.

Results:

Concentration of the 1-ethyl-3-methylimidazolium Ethyl Sulfate in 1,1,3,3-tetramethyl disiloxane Case A (separation by gravity): 300 ppm Case B (separation by centrifuging): 43 ppm Case C (separation by centrifuging and filtration): 33 ppm Estimation of the Remaining Working Medium in the Ionic Liquid:

The working medium 1,1,3,3-tetramethyl disiloxane exhibits a very high peak at 2133 $cm^{-1}$ in the infrared spectrum of a Mattson-Galaxy 2020 spectrometer with ZnSe-ATR measurement cell. At approximately the same wave number of 2130 $cm^{-1}$, the separated-off ionic liquid (Case A) exhibited an infinitesimal peak close to the resolution limit, which could be unequivocally identified as 1,1,3,3-tetramethyl disiloxane. Comparing the peak area of the pure disiloxane of 4622 units with the area of 42 units measured in the separated-off ionic liquid, the result is an estimated concentration of less than 1 percent by mass.

Experiment 2

50 g of 1-ethyl-3-methylimidazolium ethyl sulfate (ionic liquid) were stirred vigorously with 50 g of hexamethyl disiloxane (vapor-generating working medium) in a closed round-bottomed flask for 2 hours by means of a magnetic stirrer and in a heat bath at a temperature of 80° C. (typical application temperature). The mixture was transferred into a shaking funnel and was shaken very vigorously by hand for 1 minute. After the end of the shaking process, it was observed that a clean phase separation took place within a few seconds. The rest of the experimental procedure took place as in Experiment 1, described above. The linear regression of the calibration curve $R^2$ was better than 0.95.

Results:

Concentration of the 1-ethyl-3-methylimidazolium Ethyl Sulfate in Hexamethyl Disiloxane Case A (separation by gravity): 350 ppm Case B (separation by centrifuging): 55 ppm Case C (separation by centrifuging and filtration): 26 ppm Estimation of the Remaining Working Medium in the Ionic Liquid:

The working medium hexamethyl disiloxane does not exhibit any suitable bands in the infrared spectrum and was not measured.

Experiment 3

50 g of 1-ethyl-3-methylimidazolium methane sulfonate (ionic liquid) were stirred vigorously with 50 g of 1,1,3,3-tetramethyl disiloxane (vapor-generating working medium) in a closed round-bottomed flask for 2 hours by means of a magnetic stirrer and in a heat bath at a temperature of 80° C. (typical application temperature). The mixture was transferred into a shaking funnel and was shaken very vigorously by hand for 1 minute. After the end of the shaking process, it was observed that a clean phase separation took place within a few seconds. The rest of the experimental procedure took place analogously to Case C in Experiment 1, described above. The linear regression of the calibration curve $R^2$ was better than 0.95.

Results:

Concentration of the 1-ethyl-3-methylimidazolium Methane Sulfonate in 1,1,3,3-tetramethyl Disiloxane Case C (separation by centrifuging and filtration): 23 ppm Estimation of the Remaining Working Medium in the Ionic Liquid:

The working medium 1,1,3,3-tetramethyl disiloxane was measured as in Experiment 1 by means of IR spectroscopy and was estimated at <0.5 percent by mass.

Experiment 4

50 g of 1-ethyl-3-methylimidazolium methane sulfonate (ionic liquid) were stirred vigorously with 50 g of hexamethyl disiloxane (vapor-generating working medium) in a closed round-bottomed flask for 2 hours by a magnetic stirrer and in a heat bath at a temperature of 80° C. (typical application temperature). The mixture was transferred into a shaking funnel and was shaken very vigorously by hand for 1 minute. After the end of the shaking process, it was observed that a clean phase separation took place within a few seconds. The rest of the experimental procedure took place as in Case C in Experiment 1, described above. The linear regression of the calibration curve $R^2$ was better than 0.95.

Results:

Concentration of the 1-ethyl-3-methylimidazolium Methane Sulfonate in Hexamethyl Disiloxane Case C (Separation by Centrifuging and Filtration): 11 ppm Estimation of the Remaining Working Medium in the Ionic Liquid:

The working medium hexamethyl disiloxane does not exhibit any suitable bands in the infrared spectrum and was not measured.

Experiment 5

Case A: Separation by Gravity 50 g of 1-ethyl-3-methylimidazolium tris(pentafluoroethyl) trifluorophosphate (ionic liquid) were stirred vigorously with 50 g of distilled water (vapor-generating working medium) in a closed round-bottomed flask for 2 hours by means of a magnetic stirrer and in a heat bath at a temperature of 80° C. (typical application temperature). The mixture was transferred into a shaking funnel and was shaken very vigorously by hand for 1 minute. After the end of the shaking process, it was observed that a clean phase separation took place within a few seconds, and no emulsion was formed. After a waiting time of 2 minutes (typical standing time for a phase separation by gravity in the application), the two phases were separated and poured, for measurement, into sample bottles.

Case B: Separation by Filtration

The entire process was repeated with a second sample, wherein in addition to the separation by gravity, the separated-off operating medium water was filtered through a 0.45 μm PTFE diaphragm filter.

Case C: Separation by Centrifuging and Filtration)

The entire process was repeated with a third sample, wherein in addition to the separation by gravity, the separated-off working medium water was centrifuged at a speed of 5000 rpm for 10 minutes and then filtered through a 0.45 μm PTFE diaphragm filter.

Measurement of the Remaining Ionic Liquid in the Working Medium:

A weighed-out amount of a few grams of separated-off distilled water was vaporized on a rotary evaporator at 60° C. and under falling pressure to a final value of <10 mbar in order to separate the volatile working medium from the traces of the non-evaporable ionic liquid. Aside from a very small number of exceptions, ionic liquids have—as is generally known to a person skilled in the art—a nearly immeasurably low vapor pressure, and remain under said conditions quantitatively in the residue of the flask. Said residue was then swilled and homogenized with 2-propanol "puriss p.a. for UV spectroscopy" in a 10 ml measurement flask. The extinction was hereupon measured at a wavelength of 213 nm by means of a UV spectrometer versus a cuvette with 2-propanol. By standard addition of pure ionic liquid 1-ethyl-3-methylimidazolium tris(pentafluoroethyl)trifluorophosphate in 10 ppm steps calculated for the original amount of distilled water, a calibration curve was established and the amount of dissolved ionic liquid was measured and calculated for the original concentration. The linear regression of the calibration curve $R^2$ was better than 0.95.

Results:

Concentration of the 1-ethyl-3-methylimidazolium tris(pentafluoroethyl)trifluorophosphate in Distilled Water Case A (separation by gravity): 65 ppm Case B (separation by centrifuging): 45 ppm Case C (separation by centrifuging and filtration): 10 ppm Measurement of the Remaining Water in the Ionic Liquid:

The water content of the separated-off 1-ethyl-3-methylimidazolium tris(pentafluoroethyl)trifluorophosphate was determined by means of Karl Fischer coulometry to be 3100 ppm.

While there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for operating a steam cycle process using an apparatus including an evaporator or vapor generator for evaporating a liquid working medium and an expander lubricated by a lubricant, for performing mechanical work, the method comprising:

a) supplying the liquid working medium to the evaporator, in which the liquid working medium is evaporated, and supplying in vapor form the evaporated liquid medium from the evaporator to the expander;

b) supplying, as lubricant, an ionic liquid which forms two liquid phases with the liquid working medium at room temperature, to the expander; and c) separating the ionic liquid from the working medium upstream of the evaporator, wherein the solubility of the ionic liquid in the working medium is <0.1 m%, and/or the solubility of the working medium in the ionic lubricant is <1 m%.

2. The method as claimed in claim 1, further comprising:

supplying the ionic liquid to the vaporous working medium upstream of the expander, together with the working medium, and/or metering the ionic liquid into the expander.

3. The method as claimed in claim 1, further comprising:

supplying the vaporous working medium to at least one condenser in which the vaporous working medium is liquefied, before returning the vaporous working medium to the evaporator.

4. The method as claimed in claim 1, comprising separating the ionic liquid from the vaporous working medium, downstream of the expander, in a single-stage or multi-stage process.

5. The method as claimed in claim 1, comprising:

conducting the ionic liquid in a lubricant circuit including at least one reservoir;

extracting the ionic liquid from the at least one lubricant reservoir;

supplying the extracted ionic liquid to the expander; and returning the ionic liquid to the at least one lubricant reservoir from the expander.

6. The method as claimed in claim 1, wherein the apparatus implementing the steam cycle process is part of a motor vehicle, the method further comprising:

supplying waste heat of the motor vehicle to the evaporator; and using the mechanical work performed by the expander in the motor vehicle.

7. The method as claimed in claim 1, wherein the working medium comprises water vapor or a volatile substance.

8. The method as claimed in claim 1, wherein, the ionic liquid, comprises 1-ethyl-3-methylimidazolium bis(trifluoromethylsulfonyl)imide or 1-ethyl-3-methylimidazolium tris(pentafluoroethyl)trifluorophosphate, 1-ethyl-3-methylimidazolium tris(perfluoroalkyl)trifluorophosphate, 1-ethyl-3-methylimidazolium ethyl sulfate, 1-ethyl-3-methylimidazolium methyl sulfate, 1-ethyl-3-methylimidazolium methane sulfonate, 1-ethyl-3-methylimidazolium diethyl phosphate, 1-ethyl-3-methylimidazolium dibutyl phosphate, 1-ethyl-3-methylimidazolium dicyanamide, 1-ethyl-3-methylimidazolium perfluoroalkyl sulfonate, 1-ethyl-3-methylimidazolium perfluoroalkyl carboxylate, 1-ethyl-3-methylimidazolium thiocyanate, 1-ethyl-3-methylimidazolium tricyanomethide, 1-propyl-3-methylimidazolium bis(trifluoromethylsulfonyl)imide or 1-propyl-3-methylimidazolium tris(pentafluoroethyl)trifluorophosphate, 1-propyl-3-methylimidazolium tris(perfluoroalkyl)trifluorophosphate, 1-propyl-3-methylimidazolium ethyl sulfate, 1-propyl-3-methylimidazolium methyl sulfate, 1-propyl-3-methylimidazolium methane sulfonate, 1-propyl-3-methylimidazolium diethyl phosphate, 1-propyl-3-methylimidazolium dibutyl phosphate, 1-propyl-3-methylimidazolium perfluoroalkyl sulfonate, 1-propyl-3-methylimidazolium perfluoroalkyl carboxylate, 1-propyl-3-methylimidazolium dicyanamide, 1-propyl-3-methylimidazolium thiocyanate, 1-propyl-3-methylimidazolium tricyanomethide, 1-butyl-3-methylimidazolium bis(trifluoromethylsulfonyl)imide or 1-butyl-3-methylimidazolium tris(pentafluoroethyl)trifluorophosphate, 1-butyl-3-methylimidazolium tris(perfluoroalkyl)trifluorophosphate, 1-butyl-3-methylimidazolium ethyl sulfate, 1-butyl-3-methylimidazolium methyl sulfate, 1-butyl-3-methylimidazolium methane sulfonate, 1-butyl-3-methylimidazolium diethyl phosphate, 1-butyl-3-methylimidazolium dibutyl phosphate, 1-butyl-3-methylimidazolium perfluoroalkyl sulfonate, 1-butyl-3-methylimidazolium perfluoroalkyl carboxylate, 1-butyl-3-methylimidazolium dicyanamide, 1-butyl-3-methylimidazolium thiocyanate, 1-butyl-3-methylimidazolium tricyanomethide, 1-ethyl-1-methylpyrrolidinium bis(trifluoromethylsulfonyl)imide or 1-ethyl-1-methylpyrrolidinium tris (pentafluoroethyl)trifluorophosphate, 1-ethyl-1-methylpyrrolidinium tris(perfluoroalkyl)trifluorophosphate, 1-ethyl-1-methylpyrrolidinium ethyl sulfate, 1-ethyl-1-methylpyrrolidinium methyl sulfate, 1-ethyl-1-methylpyrrolidinium methane sulfonate, 1-ethyl-1-methylpyrrolidinium diethyl phosphate, 1-ethyl-1-methylpyrrolidinium dibutyl phosphate, 1-ethyl-1-methylpyrrolidinium dicyanamide, 1-ethyl-1-methylpyrrolidinium perfluoroalkyl sulfonate, 1-ethyl-1-methylpyrrolidinium perfluoroalkyl carboxylate, 1-ethyl-1-methylpyrrolidinium thiocyanate, 1-ethyl-1-methylpyrrolidinium tricyanomethide, 1-butyl-1-methylpyrrolidinium bis(trifluoromethylsulfonyl) imide or 1-butyl-1-methylpyrrolidinium tris(pentafluoroethyl)trifluorophosphate, 1-butyl-1-methylpyrrolidinium tris (perfluoroalkyl)trifluorophosphate, 1-butyl-1-methylpyrrolidinium ethyl sulfate, 1-butyl-1-methylpyrrolidinium methyl sulfate, 1-butyl-1-methylpyrrolidinium methane sulfonate, 1-butyl-1-methylpyrrolidinium diethyl phosphate, 1-butyl-1-methylpyrrolidinium dibutyl phosphate, 1-butyl-1-methylpyrrolidinium dicyanamide, 1-butyl-1-methylpyrrolidinium perfluoroalkyl sulfonate, 1-butyl-1-methylpyrrolidinium perfluoroalkyl carboxylate, 1-butyl-1-methylpyrrolidinium thiocyanate, 1-butyl-1-methylpyrrolidinium tricyanomethide, tetraalkylammonium bis(trifluoromethylsulfonyl)imide, tetraalkylammonium tris (pentafluoroethyl)trifluorophosphate, tetraalkylammonium tris(perfluoroalkyl)trifluorophosphate, tetraalkylammonium ethyl sulfate, tetraalkylammonium methyl sulfate, tetraalkylammonium methane sulfonate, tetraalkylammonium diethyl phosphate, tetraalkylammonium dibutyl phosphate, tetraalkylammonium dicyanamide, tetraalkylammonium perfluoroalkyl sulfonate, tetraalkylammonium perfluoroalkyl carboxylate, tetraalkylammonium thiocyanate, tetraalkylammonium tricyanomethide, or an ionic liquid which has fluorinated anions and/or cations with one or more medium-length alkyl chains or an ionic liquid which has small, polar anions and/or cations which comprise oxygen atoms and which have one or more short, possibly oxygen-substituted alkyl chains, or a mixture of said ionic liquids.

9. The method as claimed in claim 1, wherein the solubility of the ionic lubricant in the working medium is chosen from the group consisting of <100ppm, <10 ppm, and <1 ppm.

10. The method as claimed in claim 1, wherein the solubility of the working medium in the ionic lubricant is <0.1 m%.

11. The method as claimed in claim 4, comprising:

separating the ionic liquid from the vaporous working medium in a single-stage or multi-stage separator, wherein the condenser is arranged downstream of the expander and upstream of the separator; and supplying the mixture of working medium and ionic liquid exiting the expander to the condenser.

12. The method as claimed in claim 4, wherein the working medium exits the expander in vapor form, and the condenser is arranged downstream of the separator in the working medium circuit, the method further comprising, after said separating:

supplying at least partially vaporous working medium to the condenser.

13. The method as claimed in claim 4, wherein a lubricant reservoir is formed by at least one single or multi-stage separator downstream of the expander, the method further comprising:

supplying the mixture of working medium and ionic liquid passing from the expander to the at least one separator downstream of the expander.

14. The method as claimed in claim 13, the method further comprising:

conducting the working medium and the ionic liquid in mutually separate circuits, wherein the lubricant reservoir is formed by a vessel, the vessel accommodating the ionic liquid as liquid phase and a substantially vaporous working medium as vapor phase;

separately and independently supplying the ionic liquid and the vaporous working medium from the vessel to the expander;

supplying the ionic liquid to the vessel from the expander together with the vaporous working medium; and discharging the vaporous working medium from the vessel.

15. The method as claimed in claim 14, the method further comprising:

discharging the vaporous working medium from the vessel to the at least one separator, downstream of the expander; and supplying the working medium passing from the expander and contaminated with ionic liquid to the at least one separator.

16. The method as claimed in claim 15, the method further comprising:

supplying the vaporous working medium to a condenser;

liquefying the vaporous working medium in the condenser; and supplying the liquefied working medium to the at least one separator.

17. The method as claimed in claim 15, further comprising allowing ionic fluid to flow from the vessel to the separator; or allowing ionic fluid to flow from the separator to the vessel.

18. The method as claimed in claim 5, wherein the lubricant reservoir is formed by at least one single-stage or multi-stage separator, the method further comprising:

separating the ionic liquid from the working medium in a single-stage or multi-stage process.

19. An apparatus for operating a steam cycle process the apparatus comprising:

an evaporator or vapor generator for evaporating a liquid working medium; and an expander lubricated by a lubricant, for performing mechanical work, wherein the lubricant is formed by an ionic liquid which forms two liquid phases with the liquid working medium at room temperature, and the solubility of the ionic lubricant in the working medium is <0.1 m%, and/or the solubility of the working medium in the ionic lubricant is <1 m% .

20. The apparatus as claimed in claim 19, further comprising at least one condenser and/or at least one single or multi-stage separator downstream of the expander.

21. The apparatus as claimed in claim 19, wherein:

a first circuit is provided for the working medium and a second circuit separate from the first circuit is provided for the ionic liquid; and the at least one separator functions as a reservoir for the working medium and/or for the ionic liquid, the at least one separator being downstream of the expander, wherein the working medium contaminated with ionic liquid and passing from the expander, and/or ionic liquid contaminated with working medium, are provided to the at least one separator.

22. The apparatus as claimed in claim 20, wherein the at least one separator comprises a column-like separation vessel.

23. The apparatus of claim 20, wherein the condenser is upstream or downstream of the separator.

24. The apparatus as claimed in claim 21, further comprising:

a vessel defining a reservoir for the ionic liquid contaminated with the working medium supplied from the expander; and a line leading from the vessel to the separation device.

25. A heat recovery system for a motor vehicle, the system comprising:

an evaporator or vapor generator for evaporating a liquid working medium; and an expander lubricated by a lubricant, for performing mechanical work, wherein the lubricant is formed by an ionic liquid which forms two liquid phases with the liquid working medium at room temperature, and the solubility of the ionic lubricant in the working medium is <0.1 m%, and/or the solubility of the working medium in the ionic lubricant is <1 m% .

26. The heat recovery system as claimed in claim 25, wherein the evaporator is coupled in heat-transmitting fashion directly or indirectly to a heat source of the motor vehicle.

27. The heat recovery system as claimed in claim 25, wherein the expander is coupled in power-transmitting fashion indirectly or directly to a drivetrain, to an electric machine operable as a generator, and/or to at least one consumer, of the motor vehicle.

* * * * *